US009038413B2

(12) United States Patent
Howard et al.

(10) Patent No.: US 9,038,413 B2
(45) Date of Patent: May 26, 2015

(54) SEPARATION METHOD AND APPARATUS

(75) Inventors: Henry Edward Howard, Grand Island, NY (US); Richard John Jibb, Amherst, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 600 days.

(21) Appl. No.: 13/205,196

(22) Filed: Aug. 8, 2011

(65) Prior Publication Data

US 2011/0289964 A1 Dec. 1, 2011

Related U.S. Application Data

(62) Division of application No. 11/634,623, filed on Dec. 6, 2006, now Pat. No. 8,020,408.

(51) Int. Cl.

| | |
|---|---|
| ***F23J 3/00*** | (2006.01) |
| ***F25J 3/04*** | (2006.01) |
| ***F25J 5/00*** | (2006.01) |

(52) U.S. Cl.

CPC ..... *F25J 3/04787* (2013.01); *F25J 3/04024* (2013.01); *F25J 3/0409* (2013.01); *F25J 3/0423* (2013.01); *F25J 3/0429* (2013.01); *F25J 3/04296* (2013.01); *F25J 3/04303* (2013.01); *F25J 3/04345* (2013.01); *F25J 3/04412* (2013.01); *F25J 3/04781* (2013.01); *F25J 3/04812* (2013.01); *F25J 5/002* (2013.01); *F25J 2210/04* (2013.01); *F25J 2240/42* (2013.01); *F25J 2245/40* (2013.01); *F25J 2290/42* (2013.01); *Y10S 62/903* (2013.01); *Y10S 62/901* (2013.01)

(58) Field of Classification Search

CPC ..... F25J 2270/90; F25J 1/02; F25J 3/04412; F25J 3/04406; F25J 3/04303; F25J 3/04787

USPC ..... 62/615, 643, 646, 901, 903

See application file for complete search history.

(56) References Cited

U.S. PATENT DOCUMENTS

| | | | | |
|---|---|---|---|---|
| 3,355,901 | A | 12/1967 | Angerhofer | |
| 4,375,367 | A | 3/1983 | Prentice | |
| 4,439,220 | A | 3/1984 | Olszewski et al. | |
| 4,582,519 | A | 4/1986 | Someya et al. | |
| 4,594,085 | A | 6/1986 | Cheung | |
| 4,704,148 | A * | 11/1987 | Kleinberg | 62/646 |
| 5,123,249 | A | 6/1992 | Buttle | |
| 5,412,953 | A | 5/1995 | Darredeau et al. | |
| 5,758,515 | A * | 6/1998 | Howard | 62/646 |
| 5,802,873 | A | 9/1998 | Howard | |
| 5,983,666 | A * | 11/1999 | Straub et al. | 62/643 |
| 2001/0029751 | A1 * | 10/2001 | Nguyen et al. | 62/643 |

* cited by examiner

*Primary Examiner* — Frantz Jules
*Assistant Examiner* — Azim Abdur Rahim
(74) *Attorney, Agent, or Firm* — David M. Rosenblum

(57) ABSTRACT

Separation method and apparatus for separating a gaseous mixture, for example, air, in a cryogenic rectification plant in which a compressed stream is divided into subsidiary streams that are extracted from a main heat exchanger of the plant at higher and lower temperatures. The two streams are then combined and expanded in a turboexpander to generate refrigeration for the plant. The flow rates of the two streams are adjusted to control inlet temperature of a turboexpander supplying plant refrigeration and to minimize potential deviation of the turboexpander exhaust from a saturated vapor state. Control of the expansion ratio can advantageously be applied to allow variable liquid production from the rectification plant.

5 Claims, 4 Drawing Sheets

SEPARATION METHOD AND APPARATUS

CROSS REFERENCE TO RELATED APPLICATIONS

This application is a divisional application of U.S. patent application Ser. No. 11/634,623 filed Dec. 6, 2006, the disclosure of which is incorporated by reference herein.

FIELD OF THE INVENTION

The present invention relates to a method and apparatus for separating a gaseous mixture in a cryogenic rectification plant in which the temperature of a compressed stream of the gaseous mixture fed to a turboexpander and used to supply refrigeration to the plant is controlled by removing two streams of the compressed stream from the plant main heat exchanger, controlling the flow rates of the two streams and then combining the two streams prior to their introduction into the turboexpander.

BACKGROUND OF THE INVENTION

It has long been known to separate a variety of gaseous mixtures by cryogenic rectification, for example pretreated air and natural gas. In such processes, the gaseous mixture to be separated is pressurized, purified and then cooled to a temperature suitable for its rectification. The rectification of the gaseous mixture occurs within one or more distillation columns. Each of the columns has mass transfer elements such as trays or packing, for example, structured packing, which bring liquid and vapor phases of the gaseous mixture into contact with one another and effectuate mass transfer between the vapor and liquid phases.

The incoming feed is thereby distilled within the distillation columns or columns to form component streams enriched in the components of the gaseous mixture. The component streams can be taken as liquid and gaseous products and are used in the cooling of the gaseous mixture after having been compressed and purified to a temperature suitable for the separation of the gaseous mixture within the distillation column or columns. The cooling takes place through indirect heat exchange that is conducted in a plant main heat exchanger.

In order to minimize warm end losses in the main heat exchanger and to produce liquid products, refrigeration can be generated by expanding a compressed stream made up of the gaseous mixture and introducing the compressed stream into at least one of the columns in a plant.

It is also known to mechanically pump a liquid product, for instance in air separation, an oxygen-rich liquid column bottoms stream may be vaporized within the same main heat exchanger against a liquefying compressed air stream provided for such purpose.

Given that energy supply costs for electric power consumed in compressing the feed can vary with the time of day, there is a growing incentive to be able to manipulate plant product slates and in particular, liquid production rates. For example, high purity oxygen plants are often designed to produce anywhere of up to about 10 percent of the air as a liquefied product. There exists the need to manipulate the flow of products so that at times less than the maximum capability of the plant is utilized, for example, plant operations in which less than 10 percent of the air is taken as the liquid product. In order to change liquid production rates, it is conventional practice to adjust the turbine flow employed in generating refrigeration. An example of this can be found in U.S. Pat. No. 5,412,953. In this patent, a pumped liquid oxygen plant is described in which the liquid product make is adjusted by adjusting flow to the turboexpander. This adjustment of flow is effectuated by recycling air from the bottom of the higher pressure column to a compressor that is used in compressing the air to the turboexpander. Such operation can result in wide swings in air compression requirements that are required for such purposes as vaporizing pressurized column liquids.

Another possibility in controlling liquid production is to vary the expansion ratio of the turbine expander by increasing or decreasing the pressure of the compressed mixture being introduced into the turboexpander. This also can result in control problems in that as the pressure is increased, the mixture to be expanded may be liquefied at the exhaust of the turbine. In an extreme case where between about 10 and about 15 percent of the compressed process feed is to be liquefied. In such situations, the turbine may suffer from poor efficiency and may incur potential damage. At the other extreme, as pressure is decreased, the temperature of the expanded stream increases when the turbine inlet temperature is relatively fixed by the main heat exchanger design. When such increase is above the saturation temperature of the expanded feed to a column, liquids within the column may vaporize resulting in high local vapor flows, loss of separation performance and potential column flooding.

In the prior art, it is known to control the turboexpander inlet temperature of an air separation plant in order to prevent liquefaction in the turboexpander exhaust. For example in U.S. Pat. No. 3,355,901, a cascade control system is utilized to ensure that the exhaust of a turboexpander used in supplying refrigeration to an air separation plant is at about saturation temperature or slightly superheated. In this patent, warm vapor is divided into two streams. One stream is cooled within a heat exchanger against a cryogenic gas produced in the air separation process and the other stream by-passes the heat exchanger. The streams are then combined and introduced into the inlet of a turboexpander. The turbine exhaust temperature is sensed and a signal referable to such temperature is fed as an input into the cascade control system to control a valve that in turn controls flow of the stream that is cooled within the heat exchanger. However, it is to be noted that such arrangement is to be used in a plant that does not manipulate expansion ratio and as such the variation of turbine exhaust temperature is limited. It could not be used in a plant where expansion pressure and ratio vary substantially.

As will be described, the present invention provides a method and apparatus for separating a gaseous mixture in which refrigeration and therefore liquid production is varied by simultaneous manipulation of turbine expansion ratio and inlet temperatures. Simultaneous manipulation of turboexpander inlet temperature allows for greater variability of liquid production than would otherwise exist by manipulation of turbine expansion ratio alone.

SUMMARY OF THE INVENTION

The present invention provides a separation method in which a compressed gaseous mixture is separated within a cryogenic rectification plant by purifying the compressed gaseous mixture, cooling the compressed gaseous mixture by indirect heat exchange with mixture component streams after having been purified and then, rectifying the gaseous mixture within a separation unit. The separation unit has at least one distillation column to produce the mixture component streams.

At least one product liquid stream is discharged from the separation unit that is enriched in one mixture component of the gaseous mixture. At least part of the gaseous mixture after partial cooling thereof during the indirect heat exchange is divided into a first subsidiary stream and a second subsidiary stream. The first subsidiary stream and the second subsidiary stream are withdrawn from the indirect heat exchange at higher and lower temperatures, respectively. The first subsidiary stream and the second subsidiary stream after withdrawal from the indirect heat exchange are then combined to produce a combined stream. At least part of the combined stream is expanded with the performance of work within a turboexpander to supply refrigeration to the cryogenic plant. At least part of an exhaust stream of the turboexpander is introduced into the separation unit. The temperature of the combined stream is controlled such that the exhaust stream is at about its saturation temperature by controlling the flow rates of the first subsidiary stream and the second subsidiary stream. Here it is important to note that as used herein and in the claims, the "control of the flow rate" does not mean that the flow rates of the first subsidiary stream and the second subsidiary stream are necessarily independently controlled. In plant designs in which all of the combined stream is directed to a turboexpander, the active control of the flow rate of one of such streams will control the other of the streams. In plant designs in which not all of the combined stream is routed to the turboexpander the flow rate of such streams could be independently controlled.

The temperature control of the combined stream is advantageous in any type of cryogenic separation plant and in such plants where a pressurized liquid product is to be vaporized. The present invention, in its most basic aspect has a wider applicability in that such cryogenic separation plants sometimes require fine tuning due to unforeseen operational and environmental impacts. For instance, if the flow to the turboexpander is warmer than expected, the exhaust temperature may be higher than expected so as to cause unforeseen and excessive vaporization of liquids within the distillation columns. This having been said, the present invention has particular applicability where the pressure of the at least part of the compressed gaseous mixture is varied to in turn vary the refrigeration supplied by the turboexpander and the production rate of the liquid streams. In such cases, increasing the turboexpansion inlet pressure by increasing the pressure of the at least part of the compressed gaseous mixture increases liquid production. Decreasing the pressure of the at least part of the compressed gaseous mixture decreases liquid production. During high liquid production, the flow rates of the first subsidiary stream and the second subsidiary stream are controlled such that a flow rate of the first subsidiary stream is greater than that of the second subsidiary stream. During the low liquid mode of production the flow rates of the first subsidiary stream and the second subsidiary stream are controlled such that the flow rate of the first subsidiary stream is less than that of the second subsidiary stream.

The present invention has particular applicability to the separation of air. In this context, the compressed gaseous mixture can be composed of air. In such application, the mixture component streams are oxygen-rich and nitrogen-rich streams and the separation unit can be an air separation unit having higher and lower pressure distillation columns operatively associated with one another in a heat transfer relationship to produce the oxygen-rich and nitrogen-rich streams. Consequently, the liquid stream is enriched in one of oxygen and nitrogen.

The liquid stream can be enriched in oxygen and part of the liquid stream is pumped to produce a pressurized liquid stream. The oxygen-rich stream is formed by the pressurized liquid stream and the pressurized liquid stream is vaporized as a result of the indirect heat exchange to produce a pressurized oxygen-rich product. In such case, the compressed gaseous mixture is divided into a first compressed air stream and a second compressed air stream prior to the indirect heat exchange. The at least part of the gaseous mixture is the first compressed air stream. The second air stream, during the indirect heat exchange is condensed by indirect heat exchange with the pressurized liquid stream, thereby forming a liquid air stream. The air contained within the first compressed air stream and the second air stream is rectified within the air separation unit.

The flow rates of the first subsidiary stream and the second subsidiary stream can be controlled by a first and second pair of valves. Each pair of valves contains a high flow control valve, namely, a valve that is capable of metering high flow rates and a low flow control valve, namely, a valve that is capable of metering very low flow rates. During the high liquid mode of production, the flow rates of the first subsidiary stream and the second subsidiary stream are respectively controlled by the high flow control valve of the first pair of valves and the low flow control valve of the second pair of valves. This is because the flow rate of the first subsidiary stream is greater in such case. As a result, the low flow control valve of the first pair of valves and the high flow control valve of the second pair of valves are set in closed positions. Conversely, during the low liquid mode of production, the flow rates of the first subsidiary stream and the second subsidiary stream are respectively controlled by the low flow control valve of the first pair of valves and the high flow control valve of the second pair of valves. The high flow control valve of the first pair of valves and the low flow control valve of the second pair of valves are set in the closed positions.

The exhaust stream can be introduced into a bottom region of a higher pressure column. The liquid air stream can be divided into first and second portions and valve expanded into the higher and lower pressure columns, respectively.

A nitrogen-rich column overhead stream of the higher pressure column can be liquefied against vaporizing oxygen-rich column bottoms of the lower pressure column. This produces first and second nitrogen reflux streams to reflux the higher and lower pressure columns. The second of the nitrogen reflux streams can be subcooled prior to being introduced into the lower pressure column by exchanging heat with a waste nitrogen vapor stream and a product nitrogen vapor stream that is also withdrawn from the lower pressure column. The waste nitrogen and the product nitrogen are the nitrogen-rich streams taking part in the indirect heat exchange, mentioned above.

A crude liquid oxygen stream formed from the oxygen containing column bottoms of the higher pressure columns can be valve expanded and introduced into the lower pressure column for rectification without being subjected to indirect heat exchange to further cool the crude liquid oxygen stream prior to its being valve expanded.

In another aspect, the present invention provides a separation apparatus. In accordance with this aspect, at least one compressor is provided to compress a gaseous mixture, thereby to produce a compressed stream. A purification unit is provided to purify the compressed stream. A main heat exchanger is connected to the purification unit and is provided with flow passages for subjecting the compressed stream to indirect heat exchange with mixture component streams. A separation unit is provided consisting of at least one distillation column to rectify the gaseous mixture. The separation unit produces product fractions consisting of the mixture components. The separation unit has at least one liquid product outlet and at least one gaseous product outlet.

The main heat exchanger is connected to the separation unit such that the mixture component streams flow from the cold to the warm ends thereof. The main heat exchanger is configured to discharge a first subsidiary stream and a second subsidiary stream, respectively; the first subsidiary stream and the second subsidiary stream being made up of the gaseous mixture. The first subsidiary stream and the second subsidiary stream are discharged from the main heat exchanger at higher and lower temperatures, respectively.

A turboexpander expands at least part of the combined stream with the performance of work to supply refrigeration. The combined stream is formed from the first subsidiary stream and the second subsidiary stream and the turboexpander is connected to the separation unit such that at least part of an exhaust stream of the turboexpander is introduced into the at least one distillation column.

A flow control network is configured to mix the first subsidiary stream and the second subsidiary stream and thereby to form the combined stream. The flow control network has valves which control flow rates of the first subsidiary stream and the second subsidiary stream and therefore, the temperature of the combined stream to ensure that the exhaust from the turboexpander has an outlet temperature at least at about equal to saturation temperature.

As indicated above, the gaseous mixture can be air and the compressed stream can therefore be a compressed air stream. The mixture component streams in such an application of the present invention are oxygen-rich and nitrogen-rich streams and the separation unit can be an air separation unit having higher and lower pressure distillation columns operatively associated with one another in a heat transfer relationship, thereby to produce the oxygen-rich and nitrogen-rich streams. The turboexpander is connected to the air separation unit such that at least part of the exhaust from the turboexpander is introduced into the higher or the lower pressure distillation columns.

A pump can be provided to pressurize part of the liquid stream to produce a pressurized liquid stream. The pump is in flow communication with the separation unit and the main heat exchanger such that the pressurized liquid stream vaporizes as a result of the indirect heat exchange to produce a pressurized gaseous product. The compressed air stream is a first compressed air stream and the at least one compressor is part of a compression system.

The compression system is provided with a base load compressor. A turbine loaded booster compressor is also provided in flow communication with the base load compressor and operatively associated with the turboexpander to at least be partially driven by the work of the turboexpander. A first compressor is connected to the turbine loaded booster compressor and the first compressed air stream is thereby produced by the turbine loaded booster compressor and the first compressor. Additionally, a second compressor is provided in flow communication with the base load compressor to produce the second compressed air stream. The second compressor is also in flow communication with the main heat exchanger and the main heat exchanger is also in flow communication with the air separation unit such that the second compressed air stream is subjected to the indirect heat exchange causing the vaporization of the pressurized liquid stream and the second compressed air stream to liquefy, thereby to form a liquid air stream and the liquid air stream is introduced into the air separation unit.

The first compressor can be provided with inlet guide vanes or the compression system can be provided with a by-pass line having a cut-off valve to by-pass the first compressor when the cut-off valve is set in an open position. This allows the pressure of the second air stream to be varied to in turn vary the refrigeration supplied by the turboexpander and therefore, production of the liquid stream.

The valves of the flow control network can include a first and a second pair of valves connected to the main heat exchanger and each pair containing a high flow control valve and a low flow control valve. During the high liquid mode of production, the flow rates of the first subsidiary stream and the second subsidiary stream are respectively controlled by the high flow control valve of the first pair of valves and the low flow control valve of the second pair of valves. During such time, the low flow control valve of the first pair of valves and the high flow control valve of the second pair of valves are set in closed positions. During the low liquid mode of production, the flow rates of the first subsidiary stream and the second subsidiary stream are controlled by the low flow control valve of the first pair of valves and the high flow control valve of the second pair of valves. At this time, the high flow control valve of the first pair of valves and the low flow control valve of the second pair of valves are set in closed positions. Additionally, the flow control network is provided with a static mixer or similar device interposed between the first and second pair of valves and the turboexpander to mix the first subsidiary stream and the second subsidiary stream.

In addition, the turboexpander can be connected to a bottom section of the higher pressure column and the main heat exchanger can be connected to the air separation unit so that first and second portions of the liquid air stream are introduced into the higher and lower pressure columns. Expansion valves are positioned between the main heat exchanger and the higher and lower pressure columns so that the first and second portions are valve expanded to the higher and lower pressures of the higher and lower pressure columns.

Additionally, as also discussed above with respect to the method, a condenser-reboiler can be operatively associated with the higher and lower pressure columns so that a nitrogen-rich column overhead stream of the higher pressure columns can be liquefied against vaporizing an oxygen-rich column bottoms of the lower pressure column to produce first and second nitrogen reflux streams to reflux the higher and lower pressure columns. A subcooler can be provided to subcool the second of the nitrogen reflux streams prior to being introduced into the lower pressure column. The subcooler is configured to subcool the second of the nitrogen vapor stream and a product nitrogen vapor stream withdrawn from the lower pressure column. The subcooler is connected to the main heat exchanger so that the waste and product nitrogen streams are therefore the nitrogen-rich streams taking part in the indirect heat exchange within the main heat exchanger.

A conduit can connect the bottom region of the higher pressure column to an intermediate location of the lower pressure column to introduce a crude liquid oxygen stream formed from the oxygen containing column bottoms of the higher pressure columns into the lower pressure columns for rectification. A further expansion valve is positioned within the conduit to expand the crude liquid oxygen stream to a compatible pressure of the lower pressure column at its point of introduction.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which:

DETAILED DESCRIPTION

Figure 1:
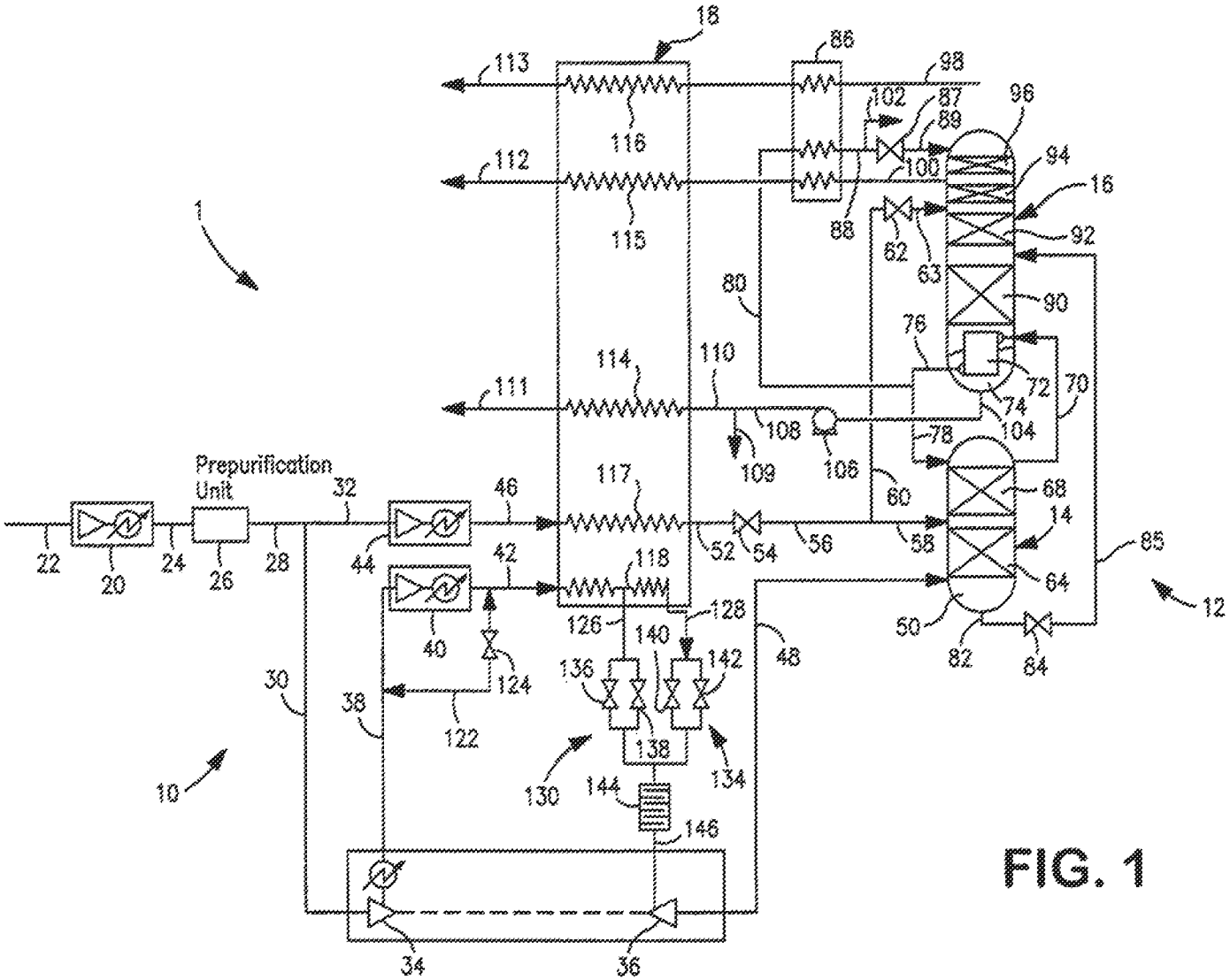
FIG. 1 is a schematic view of an air separation plant for carrying out a method in accordance with the present invention.

With reference to FIG. 1, an air separation plant 1 is illustrated for exemplary purposes. As indicated above, the present invention in its more broader aspects has equal application to other separation process, for example, those involving natural gas.

Air separation plant 1 includes a compression system 10 to compress the air to pressures suitable for its rectification within an air separation unit 12 having a higher pressure column 14 and a lower pressure column 16. Rectification of the air separates the components of the air into oxygen-rich and nitrogen-rich fractions that are extracted as oxygen-rich and nitrogen-rich streams that are introduced into a main heat exchanger 18 to indirectly exchange heat from the compressed air to the oxygen-rich and nitrogen-rich streams and thereby to cool the compressed air to a temperature suitable for the rectification thereof. As would occur to those skilled in the art, in other separation processes, a feed such as natural gas might be obtained at pressure thus obviating the need for compression within the plant itself.

Having briefly described the air separation plant 1, a more detailed description begins with compression system 10. Compression system 10 includes a base load compressor 20 to compress an incoming air stream 22 to a pressure that can be within the range of between about 5 and about 15 bars absolute ("bara"). Compressor 20 may be an inter-cooled integral gear compressor with condensate removal.

The resultant compressed air stream 24 is then directed to a prepurification unit 26 that may comprise several unit operations, all known in the art, including: direct water cooling; refrigeration based chilling; direct contact with chilled water; phase separation and/or adsorption within adsorbent beds operating out of phase containing, typically an alumina adsorbent. Prepurification unit 26 produces a purified compressed stream 28 that has a very low content of higher boiling contaminants such as water and carbon dioxide that could otherwise freeze within main heat exchanger 18 and hydrocarbons that could collect within air separation unit 12 and present a safety hazard.

Purified compressed air stream 28 is divided into streams 30 and 32. Stream 30 is subjected to further compression within a turbine loaded booster compressor 34 that is operatively associated with a turboexpander 36 to recover some of the work of expansion in operation of booster compressor 34. A stream 38 is produced by the compression that can have a pressure that can be typically between about 15 and about 20 bara. Steam 38 is then further compressed by a compressor 40 to produce a first compressed air stream 42 having a pressure of between about 20 and about 60 bara.

Stream 32 can constitute between about 25 percent and about 35 percent of purified compressed air stream 28 and is further compressed within a compressor 44 to produce a second compressed air stream 46 having a pressure of between about 25 and about 70 bara.

As will be discussed, first compressed air stream 42 after having been cooled and subjected to temperature control in accordance with the present invention is introduced into turboexpander 36. An exhaust of turboexpander 36, exhaust stream 48, is introduced into a bottom region 50 of higher pressure column 14. The second compressed air stream 46, as will be discussed, condenses within main heat exchanger 18 against the vaporization of a pressurized product to produce a liquid air stream 52 that is valve expanded within an expansion valve 54 to a pressure suitable for its entry into higher pressure column 14 to produce a reduced pressure liquid stream 56. In this regard, the higher pressure column 14 can operate at a pressure of between about 5 and about 6 bara. A first portion 58 of reduced pressure liquid stream 56 is introduced into higher pressure column 14 and a second portion 60 of reduced pressure liquid stream 52, after having been expanded in an expansion valve 62 to a pressure suitable for its introduction into lower pressure column 16, is then introduced into lower pressure column 16 as a stream 63. In this regard lower pressure column 16 can operate at a pressure of between about 1.1 and 1.4 bara.

The higher pressure column 14 is provided with mass transfer elements 64 and 68, schematically illustrated, that can be structured packing. The vapor introduced via exhaust stream 48 initiates an ascending vapor phase that contacts a descending liquid phase that descends within mass transfer elements 64 and 68. Additionally, first portion 58 of reduced pressure liquid stream 56 descends within packing element 64 and the evolved vapor will ascend through a packing element 68. As the vapor ascends within higher pressure column 14 it becomes evermore rich in the lighter components of the air, namely, nitrogen and as the liquid descends within the higher pressure distillation column 14, the liquid becomes evermore rich in the heavier components of the air, namely, oxygen, to produce a crude liquid oxygen column bottoms stream 82 that collects within bottom region 50 of distillation column 14.

A nitrogen-rich column overhead stream 70 is introduced into a condenser reboiler 72 located within the bottom of lower pressure column 16 where it vaporizes some of the oxygen-rich liquid column bottoms 74 that collects within lower pressure distillation column 16 by virtue of the distillation occurring within such column. This produces a liquid nitrogen stream 76 that is divided into first and second nitrogen reflux streams 78 and 80 to reflux the higher and lower pressure columns 14 and 16, respectively. The reflux provided in higher pressure column 14 by virtue of the first nitrogen reflux stream 78 initiates the formation of the descending liquid phase. A crude liquid oxygen stream 82 composed of the crude liquid oxygen column bottoms within higher pressure column 14 is valve expanded within an expansion valve 84 to the pressure of lower pressure column 16 and is introduced into lower pressure column 16 as a stream 85. The second nitrogen reflux stream 80 is subcooled within a subcooling unit 86 to form a stream 88 to reflux the lower pressure column 16. All or a portion of stream 88 may be introduced into lower pressure column 16 as a stream 89 after passage through valve 87. A portion of stream 88 may be taken as a liquid product 102 and directed to suitable storage (not shown).

The lower pressure column 16 is provided with mass transfer contacting elements 90, 92, 94 and 96 that contacts liquid and vapor phases within lower pressure columns 16 to produce the oxygen-rich liquid column bottoms 74, a nitrogen product vapor stream 98 and a waste nitrogen vapor stream 100 that are passed into subcooling unit 86 to subcool second nitrogen reflux stream 80.

An oxygen-rich liquid stream 104 composed of the oxygen-rich liquid column bottoms 74 can be pressurized by way of a pump 106 to produce a pressurized liquid oxygen stream 108. Part of the pressurized liquid oxygen stream 108 is vaporized within main heat exchanger 18. As illustrated, a pressurized liquid oxygen product stream 109 can be taken as a product. In such case, the remainder, stream 110 is vaporized within main heat exchanger 18 to produce a pressurized oxygen product stream 111 that can be taken as a high pressure oxygen product. Additionally, waste nitrogen stream 100 can also be warmed in the main heat exchanger 18 to form waste stream 112 and product nitrogen vapor stream 98 can be warmed within main heat exchanger 18 to form a nitrogen-enriched product stream 113. Heat exchange passes 114', 115', 116' and 117' are provided within main heat exchanger 18 for such purposes as have been outlined above and passes 118, that will be discussed in further detail hereinafter for cooling the first compressed air stream 42.

In accordance with the present invention, liquid production of air separation plant 1, namely pressurized liquid oxygen product stream 109 and liquid nitrogen product stream 102, are varied by varying the pressure in the first compressed air stream 42. This variation in pressure can be effectuated by a by-pass line 122 having a valve 124 that can be set in an open and closed position for controlling the by-pass by either allowing flow within by-pass line 122 or cutting off the flow to by-pass line 122. Alternatively, line 122 may be configured for recirculation of compressor 40. Additionally, in place of by-pass line 122, compressor 40 could be provided with variable inlet vanes to vary the pressure of first compressed air stream 42.

During a high mode of liquid production, if the pressure of first compressed air stream 42 is increased, there will be more refrigeration produced and more liquid will therefore be produced. Conversely, if the pressure of the first compressed air stream 42 is reduced, there will be less refrigeration produced by turboexpander 36 and therefore a decrease in liquid production.

However, in high liquid modes of production first compressed air stream 42 can be partly liquefied due to its high pressure and the cooling within main heat exchanger 18. The control of temperature of the inlet stream to turboexpander 36 is accomplished by configuring the main heat exchanger to discharge the first subsidiary stream 126 and the second subsidiary stream 128 at higher and lower temperature to in turn control the temperature of the stream fed to the inlet of the turboexpander 36. In order to control the temperature at the inlet of turboexpander 36, pairs of control valves 130 and 134 are provided. The first pair of control valves 130 has a high flow control valve 136 and a low flow control valve 138. Similarly the second pair of flow control valves has a high flow control valve 140 and a low flow control valve 142. These valves are termed "high flow" and "low flow" in a comparative sense. For example, a "high flow" valve is one where the volumetric flow rate is anywhere from about 10 and about 100 times that of a "low flow" valve. However, the sizing of the high flow control valves relative to the low flow control valves would depend on a specific application of the present invention. Physically, the low flow valves are thus much smaller units than the high flow control valves.

During the high mode of liquid production, high flow control valve 136 is controlling the flow of the predominant part of the flow contained within first subsidiary stream 126. Low flow control valve 138 will be in a closed position. Additionally, high flow control valve 140 will also be closed and the low flow control valve 142 will be open to control the flow of second subsidiary stream 128 that will be either in a dense phase or a liquid phase. In the low liquid production mode, now most of the flow goes with second subsidiary stream 128. Thus, high flow control valve 136 is set in the closed position and low flow control valve 138 is set in the open position. Similarly, the high flow control valve 140 now controls the flow of second subsidiary stream 128 and low flow control valve 142 is set in the closed position.

The flow of first subsidiary stream 126 and second subsidiary stream 128 are then combined within a static mixer 144 to produce a combined stream 146 that can be introduced into the inlet of turboexpander 36 at a controlled temperature.

As indicated above, the temperature control of combined stream 146 is provided in a manner that ensures that turbine exhaust stream 48 is not substantially liquefied or in other words has a liquid content of no greater than about 5 percent. More preferably, the exhaust stream will remain at or near the saturation vapor temperature. From the standpoint of column operation, variations above saturation temperature may now be effectively limited to less than about 20° C. Hence, the term "about" when used herein and in the claims in connection with the saturation vapor temperature means a temperature that is not lower than a temperature at which more than about 5 percent of liquefaction is in the turboexpander exhaust and not higher than a temperature that will result in a superheating of the exhaust beyond about 20° C. In order to accomplish this, the control of high and low flow control valves 136, 138, 140 and 142 could be set at pre-specified positions to obtain a controlled temperature of combined stream 146. More preferably, closed loop control will be employed. In such an approach, the temperature of stream 146 is maintained by sensing the temperature of combined stream 146 and comparing its value to a predetermined value/setpoint and adjusting the positions of valves 136, 138, 140 and 142 accordingly. Such control is often referred to as PID control (proportional, integral and derivative control) as is well known to the art of process engineering. Alternatively, the temperature difference between exhaust stream 48 and stream 82 could also be monitored. The subject valves would then be manipulated to control the outlet temperature of the turbine in response. In so doing, the turbine superheat is maintained at some predetermined approach to saturation.

The table below represents a calculated example generated by way of a steady state process simulation that illustrates key operational features of air separation plant during periods of both high and low liquid production. In this example gaseous oxygen stream 111 is produced from the process at a pressure 30 bara. The higher pressure column 14 operates at 5.2 bara. Further, in this example, all of the expansion flow of stream 30 passes through the expander 36 and into column 14. The temperatures of the first and second subsidiary streams 126 and 128 were obtained by a rigorous solution for a fixed brazed aluminum heat exchanger design such as the one illustrated in FIG. 2 and described in more detail hereinafter. Upon the initiation of high liquid production mode the exiting second subsidiary stream 128 is in a substantially liquefied state.

TABLE

| Stream and Operational Conditions | Low Liquid Production | High Liquid Production |
|---|---|---|
| EXPANSION PRESSURE RATIO of combined stream 146 and turbine exhaust stream 48 | 3.0 | 8.6 |
| EXPANSION FLOW FRACTION of stream 30 relative to purified air stream 28 | 0.656 | 0.669 |
| LIQUID PRODUCT FLOW FRACTION (the sum of flow rates of liquid product streams 102 and 109 divided by the flow rate of the entire incoming air stream 22) | 0.034 | 0.106 |
| SECOND SUBSIDIARY FLOW FRACTION of second subsidiary stream 128 to stream 30 | 0.989 | 0.004 |
| TEMPERATURE OF FIRST SUBSIDIARY STREAM 126 | −100.6 | −93.4 |
| TEMPERATURE OF SECOND SUBSIDIARY STREAM 128 | −133.4 | −136.8 |
| TURBINE EXHAUST STREAM 48 SUPERHEAT (in degrees centigrade) | 9.5 | 1.3 |

A simulation of the subject process in a plant such as air separation plant 1 in which the heat exchanger is designed in the conventional manner (for the low liquid production mode and without temperature control for the turboexpander inlet) results in the turbine exhaust (stream 48) exhibiting a liquid fraction of roughly 30 percent. From a thermodynamic standpoint, the turbine work to flow ratio of the conventional approach would be 45 percent lower than that achievable through the application of the disclosed invention. In other words, the refrigeration potential from the same expansion ratio is greatly enhanced through the current invention.

It is understood that all of the combined stream 146 need not proceed to expander 36. If desired, a portion of combined stream 146 can be directed back to the main heat exchanger 18 for further cooling and liquefaction and fed to the air separations unit 12. Similarly, not all of the exhaust stream 48 need be directed to the air separation unit 12. For example, a portion of the turbine exhaust 48 could be recirculated to the compressor 20 or the outlet of prepurification unit 26. Additionally, exhaust stream 48 could be introduced into the lower pressure distillation column 16. In such case, a portion of the stream could be directed to the waste stream or warmed and then vented. Although not illustrated, the present invention is equally applicable to air separation plants that employ different configurations than that illustrated in FIG. 1. For example, the present invention has application to air separation plants in which there is no liquid pumping of a product stream or in which all of the oxygen-enriched liquid is taken as a product and none vaporized. In case of a plant that does not employ liquid pumping, there would be no compressed air stream such as second compressed air stream 46 and the apparatus associated with the production and cooling of such stream. Even where there is vaporization of a product stream within a main heat exchanger, the streams emanating from the base load compression, such as streams 30 and 32, might be compressed to about the same nominal pressure with the pressure of one of the streams being introduced into a turboexpander varied to vary liquid production together with a temperature control as provided herein. As also indicated above, the present invention has application to other cryogenic separation plants that do not involve the separation of air.

Figure 2:
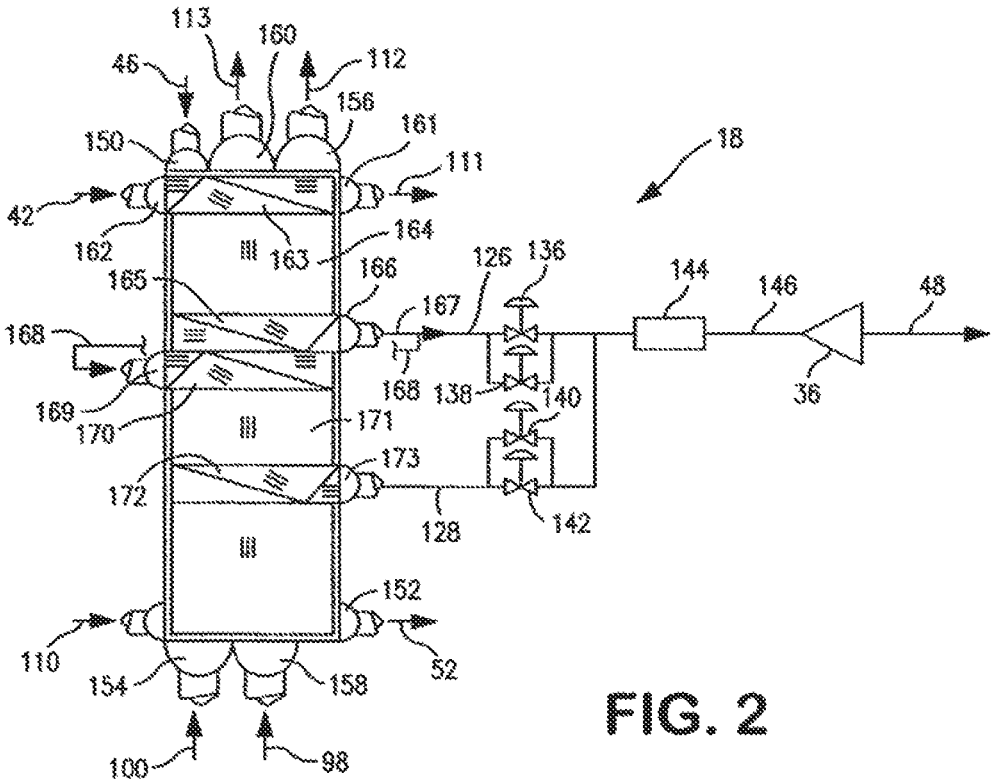
FIG. 2 is an elevational view of a main heat exchanger employed in the air separation plant illustrated in FIG. 1.

With reference to FIG. 2, heat exchanger 18 is illustrated in more detail. As would be understood by those skilled in the art, heat exchanger 18 is oriented in a vertical position and can be a plate-fin type heat exchanger that has multiple layers of plates defining finned flow passages to define the heat exchange passes 114, 115, 116 and 117 and thereby to effectuate the heat exchange in a manner known in the art. In this regard, second compressed air stream 46 is introduced into an inlet header 150 and the liquid air stream 52 is discharged from an outlet header 152. The flow of such streams is throughout the entire length of heat exchanger 18 and between finned flow passages located between plates. Similarly, waste nitrogen stream 100 also flows the entire length of heat exchanger 18 and is introduced though an inlet header 154 and is discharged as waste stream 112 from an outlet header 156. The nitrogen vapor product stream 98 is introduced into an inlet header 158 and is discharged from an outlet header 160 as nitrogen-enriched product stream 113. The pumped liquid oxygen-enriched stream 110 is introduced into an inlet header 159 and is discharged as the pressurized oxygen product stream 111 from header 161.

First compressed air stream 42 is introduced into heat exchanger 18 through an inlet header 162 and is redirected by distribution fins 163 to flow in a lengthwise direction of heat exchanger 18 and through a finned passage 164. After partly traversing the length of heat exchanger 18, the flow is then redirected by distribution fins 165 and is discharged through an outlet header 166 as a stream 167. Part of such stream 167 is discharged from outlet header 166 as a stream 168 that is then reintroduced into heat exchanger 18 through an inlet header 169 and a remaining part of stream 167 forms first subsidiary stream 126. Stream 168 is then redirected by distribution fins 170 to flow in the lengthwise direction of heat exchanger 18 through a finned passage 171. After having been further cooled by partial traverse of heat exchanger 18 through finned passage 171, stream 168 is then redirected again by way of distribution fins 172 and is discharged through an outlet header 173 as stream 128.

It is to be noted that as could well be appreciated by those skilled in the art, the layers of finned passages 164 and 171 thereby form the heat exchange passes, designated in FIG. 1 by reference numeral 118, for first compressed air stream 42 that are used in forming first subsidiary stream 126 and second subsidiary stream 128.

Figure 3:
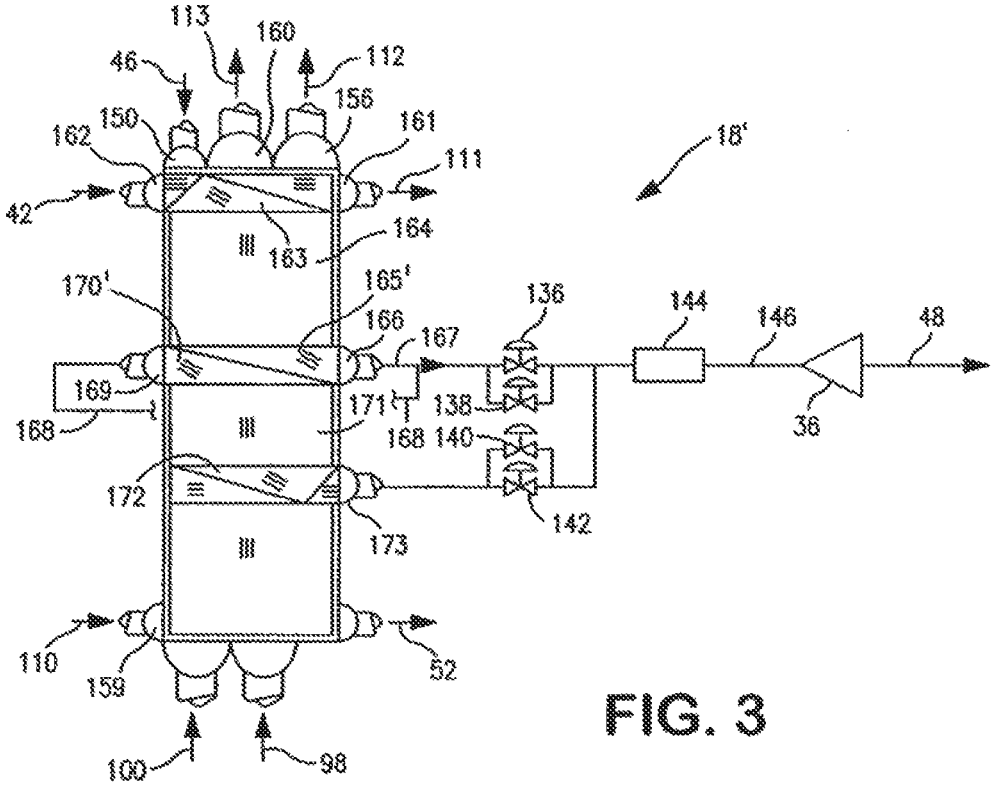
FIG. 3 is an alternative embodiment of FIG. 3.

With reference to FIG. 3, in an alternative embodiment of main heat exchanger 18, a main heat exchanger 18' is provided with an outlet header 166 and inlet header 169 could be placed opposite one another. In such case, distribution fins 165 and 170 are replaced by an arrangement of distribution fins 165' and 170' that are separated by a diagonal partition to divide the flow.

Figure 4:
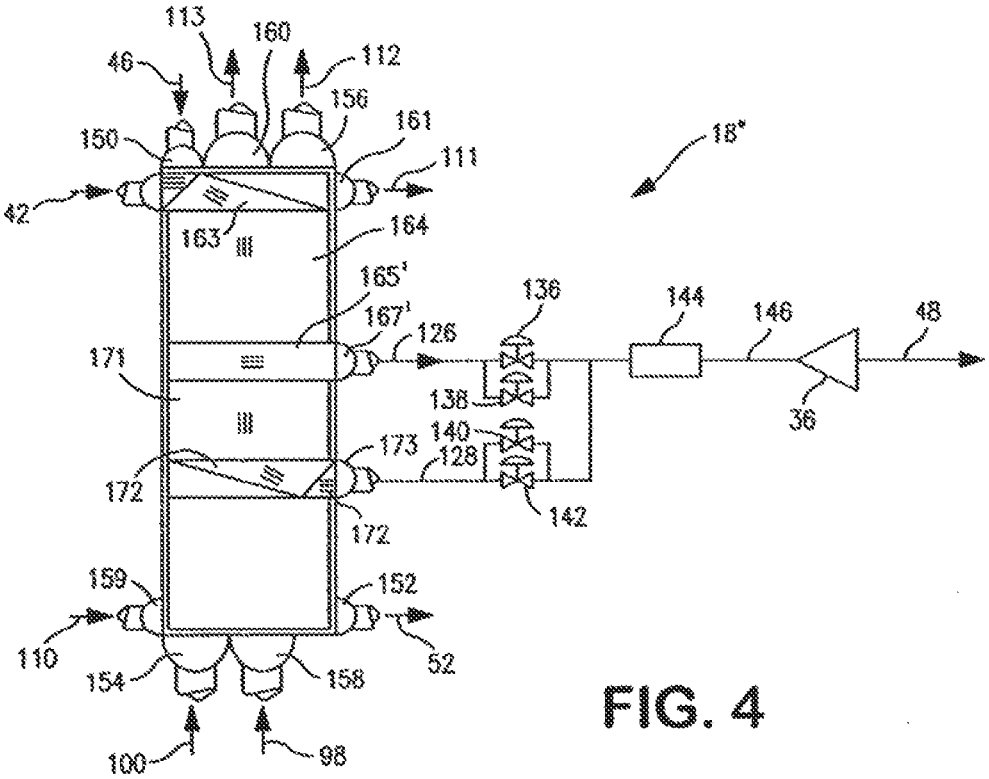
FIG. 4 is an alternative embodiment of FIG. 3.

With reference to FIG. 4, in an alternative embodiment of heat exchanger 18, a heat exchanger 18" is provided with a hard way fin section 165'. A hard way fin section is a section of fin arranged to produce a principal flow resistance parallel to the flow direction that is greater than the flow resistance perpendicular to the flow direction. When valve 136 is open, this acts to split the flow so that first subsidiary stream 126 is discharged from outlet header 167' at a higher flow rate than a remaining portion of the stream flowing within finned passage 164. The remaining portion then flows through finned passage 171 and is then redirected by distribution fins 172 to outlet header 173 as second subsidiary stream 128 that is further cooled due to its continued traverse of heat exchanger 18".

Figure 5:
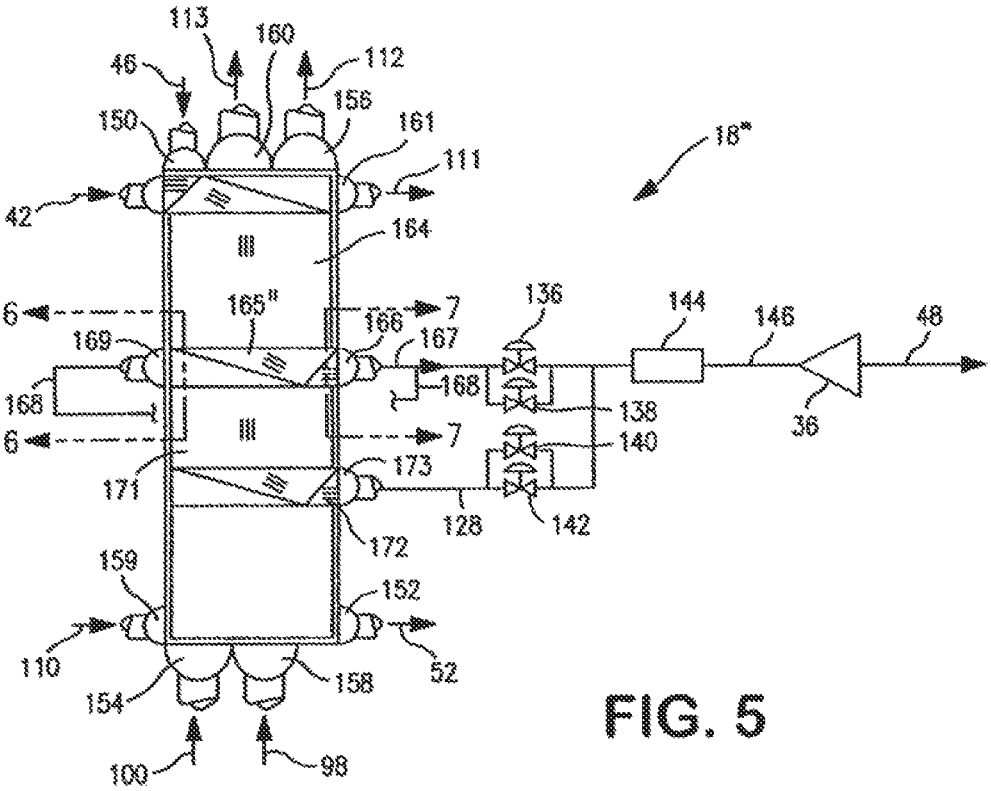
FIG. 5 is an alternative embodiment of FIG. 3.
Figure 6:
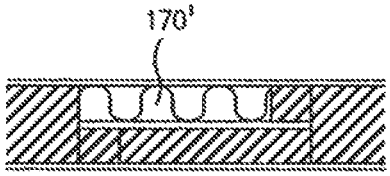
FIG. 6 is a sectional view of FIG. 5 taken along line 6-6 thereof.
Figure 7:
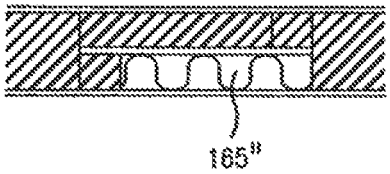
FIG. 7 is a sectional view of FIG. 5 taken along line 7-7 thereof.

With reference to FIG. 5, a heat exchanger 18'" is presented as an alternative embodiment to heat exchanger 18. With additional reference to FIGS. 7 and 8, a layer of distributor fins 165" is provided to redirect the flow from finned passage 164 to outlet header 166. The stream 168, enters inlet header 169 and then flows through distributor fins 170' to be directed to finned passage 171 for discharge from discharge header 173 as second subsidiary stream 128. Fins 165" and 170' have a height which is approximately half of the main passage height. They are placed on top of one another with a dividing plate in between. In this way the inlet and outlet distribution can be achieved in a smaller volume, although the pressure drop incurred will be higher (as a result of reducing the flow area by half).

While the invention has been described with reference to a preferred embodiment, as will occur to those skilled in the art, numerous changes and additions can be made without departing from the spirit and the scope of the present invention as recited in the appended claims.

We claim:

1. A separation apparatus comprising:

a compression system to compress a gaseous mixture thereby to produce a compressed stream and a purification unit connected to the compression system so that the compressed stream is purified;

a main heat exchanger connected to the compression system having flow passages for subjecting the compressed stream to indirect heat exchange with mixture component streams;

a separation unit having at least one distillation column to rectify the gaseous mixture contained in the compressed stream, thereby to produce the mixture component streams;

the separation unit having a liquid outlet to discharge a liquid stream enriched in one mixture component of the gaseous mixture;

the main heat exchanger connected to the separation unit such that the mixture component streams flow from cold to warm ends thereof;

the main heat exchanger configured to discharge a first subsidiary stream and a second subsidiary stream at higher and lower temperatures, respectively, the first subsidiary stream and the second subsidiary stream made-up of the compressed stream;

a turboexpander to expand at least part of a combined stream with the performance of work to supply refrigeration, the combined stream formed from a mixture of the first subsidiary stream and the second subsidiary stream and the turboexpander connected to the separation unit such that at least part of an exhaust stream of the turboexpander is introduced into the at least one distillation column;

the compression system having a base load compressor, a turbine loaded booster compressor in flow communication with the base load compressor and operatively associated with the turboexpander to at least be partially driven by the work of the turboexpander and a further compressor connected to the turbine loaded booster compressor;

the further compressor having inlet guide vanes or the compression system having a by-pass line having a cut-off valve to by-pass the further compressor when the cut-off valve is set in an open position such that the compressed stream is delivered from the further compressor or through the bypass to allow the pressure of the compressed air stream to be varied to in turn vary the refrigeration supplied by the turboexpander and production of the liquid stream such that increasing the pressure of the compressed stream in a high liquid mode of production increases the production of the liquid products and decreasing the pressure of the compressed stream in a low liquid mode of production decreases the production of the liquid products;

a flow control network configured to mix the first subsidiary stream and the second subsidiary stream and thereby to form the combined stream, the flow control network having a first and a second pair of valves connected to the main heat exchanger to control flow rates of the first subsidiary stream and the second subsidiary stream, respectively, and therefore, the temperature of the combined stream to ensure that the exhaust stream from the turboexpander has an outlet temperature at least at about equal to saturation temperature and a static mixer interposed between the first and second pair of valves and the turboexpander to mix the first subsidiary stream and the second subsidiary stream; and each of the first and the second pair of valves containing a high flow control valve and a low flow control valve such that during the high liquid mode of production, the flow rates of the first subsidiary stream and the second subsidiary stream are able to be respectively controlled by the high flow control valve of the first pair of valves and the low flow control valve of the second pair of valves, the low flow control valve of the first pair of valves and the high flow control valve of the second pair of valves being set in closed positions and during the low liquid mode of production, the flow rates of the first subsidiary stream and the second subsidiary stream are respectively controlled by the low flow control valve of the first pair of valves and the high flow control valve of the second pair of valves, the high flow control valve of first pair of valves and the low flow control valve of the second pair of valves being set in closed positions.

2. The separation apparatus of claim 1, wherein:

the gaseous mixture is air;

the compressed stream is a compressed air stream;

the mixture component streams are oxygen-rich and nitrogen-rich streams;

the separation unit is an air separation unit having higher and lower pressure distillation columns operatively associated with one another in a heat transfer relationship, thereby to produce the oxygen-rich and nitrogen-rich streams; and the turboexpander is connected to the air separation unit such that at least part of the exhaust stream from the turboexpander is introduced into the higher or the lower pressure distillation columns.

3. The separation apparatus of claim 2, further comprising:

a pump to pressurize part of the liquid stream to produce a pressurized liquid stream;

the pump being in flow communication with the separation unit and the main heat exchanger such that the pressurized liquid stream vaporizes as a result of the indirect heat exchange to produce a pressurized product;

the compressed air stream is a first compressed air stream;

the further compressor is a first compressor;

and the compression system has a second compressor also in flow communication with the base load compressor to produce a second compressed air stream; and the second compressor is in flow communication with the main heat exchanger and the main heat exchanger is also in flow communication with the air separation unit such that the second compressed air stream is subjected to the indirect heat exchange causing the vaporization of the pressurized liquid stream and the second compressed air stream to liquefy, thereby to form a liquid air stream and the liquid air stream is introduced into the air separation unit.

4. The separation apparatus of claim 3, wherein:

the turboexpander is connected to a bottom section of the higher pressure column so that the exhaust stream is introduced into the bottom section of the higher pressure column; and the main heat exchanger is connected to the air separation unit so that first and second portions of the liquid air stream are introduced into the higher and lower pressure columns and expansion valves are positioned between the main heat exchanger and the higher and lower pressure columns so that the first and second portions are valve expanded to higher and lower pressures of the higher and lower pressure columns, respectively.

5. The separation apparatus of claim 4, wherein:

a condenser-reboiler is operatively associated with the higher and lower pressure columns so that a nitrogen-rich column overhead stream of the higher pressure column is liquefied against vaporizing an oxygen containing column bottoms of the lower pressure column, thereby to produce first and second nitrogen reflux streams to reflux the higher and lower pressure column;

a subcooler configured to subcool the second of the nitrogen reflux streams prior to being introduced into the lower pressure column through heat exchange with a waste nitrogen stream and a product nitrogen stream discharged from the lower pressure column;

the subcooler is connected to the main heat exchanger so that waste nitrogen stream and the product nitrogen stream are the nitrogen-enriched streams taking part in the indirect heat exchange within the main heat exchanger; and a conduit connects the bottom region of the higher pressure column to an intermediate location of the lower pressure column to introduce a crude liquid oxygen stream formed from an oxygen containing column bottoms of the higher pressure column is introduced into the lower pressure column for rectification and a further expansion valve is positioned within the conduit to expand the crude liquid oxygen stream to a compatible pressure of the lower pressure column at its point of introduction.

* * * * *